US006012573A

United States Patent [19]

Kurimoto

[11] Patent Number: 6,012,573

[45] Date of Patent: Jan. 11, 2000

[54] SHIRT HOLDER

[76] Inventor: Masao Kurimoto, 3-4, Tsujido Higashi-Kaigan 3-chome, Fujisawa-shi, Kanagawa-ken, Japan

[21] Appl. No.: 08/873,233

[22] Filed: Jun. 11, 1997

[30] Foreign Application Priority Data

Oct. 7, 1996 [JP] Japan ..... 8-266022

[51] Int. Cl.[7] ..... B65D 85/18; B65D 43/03

[52] U.S. Cl. ..... 206/278; 206/284; 206/298; 229/87.17

[58] Field of Search ..... 206/278, 284, 206/298; 229/87.17; 220/213, 532

[56] References Cited

U.S. PATENT DOCUMENTS

| | | | |
|---|---|---|---|
| D. 183,095 | 6/1958 | Hesse | 206/278 X |
| 593,346 | 11/1897 | Baehn | 206/278 X |
| 905,897 | 12/1908 | Manahan | 206/278 X |
| 1,115,639 | 11/1914 | Wilson | 229/87.17 |
| 2,764,280 | 9/1956 | Carper | 229/87.17 X |
| 3,069,009 | 12/1962 | Hoeflich | 206/284 |
| 3,144,721 | 8/1964 | Woloz | 206/278 X |
| 3,256,975 | 6/1966 | Puente | 220/532 X |
| 3,502,244 | 3/1970 | Irvin | 206/292 X |
| 3,756,398 | 9/1973 | Green et al. | 206/278 X |
| 4,139,095 | 2/1979 | Weaver | 206/278 |
| 5,027,945 | 7/1991 | Wilkins | 206/278 |
| 5,316,139 | 5/1994 | Judd et al. | 206/278 |
| 5,556,014 | 9/1996 | Kolton et al. | 206/292 X |

FOREIGN PATENT DOCUMENTS

| | | | |
|---|---|---|---|
| 38230 | 10/1981 | European Pat. Off. | 220/213 |
| 2704528 | 11/1994 | France | 206/278 |
| 2646894 | 4/1978 | Germany | 229/87.17 |
| 3021250 | 12/1981 | Germany | 220/213 |
| 3440033 | 5/1986 | Germany | 206/278 |
| 5170267 | 7/1993 | Japan | 206/278 |
| 15698 | 2/1915 | United Kingdom | 206/278 |
| 325767 | 2/1930 | United Kingdom | 206/292 |

*Primary Examiner*—Sue A. Weaver
*Attorney, Agent, or Firm*—Griffin, Butler, Whisenhunt & Szipl, LLP

[57] ABSTRACT

A shirt holder comprising, integrally formed, a back pressing planar portion having a rectangular configuration for supporting a back face of a folded shirt, a front pressing planar portion facing opposite to the back pressing planar portion, a shirt collar protection portion, a connector portion bendably connecting a lower edge of the back pressing planar portion with a lower edge of the front pressing planar portion, and linear projections projecting inwardly of the front pressing planar portion and/or the back pressing planar portion. The linear projections are formed on opposing surface portions of the front pressing planar portion and/or the back pressing planar portion. The linear projections may be formed as linear engagement projections for engaging the back pressing planar portion with the front pressing planar portion on peripheral portions of the back pressing planar portion and the front pressing planar portion where the connector portion is not present. The shirt holder can prevent the positional offset of a shirt held therein, and therefore will prevent a shirt from sliding down within it when it is hung on a rack, e.g. for display in a shop. The shirt holder also permits shirts of the like to be stored in a stacked state, hung on a rack for display, or packed e.g. in a suitcase, with the shape of the shirt kept intact.

27 Claims, 13 Drawing Sheets

SHIRT HOLDER

BACKGROUND OF THE INVENTION

1. Field of the Invention

The present invention relates to a shirt holder for holding a man's shirt newly fabricated and to be delivered by a maker, or a garment with a collar such as a man's shirt, a lady's blouse, a polo shirt or a sports shirt freshly laundered and neatly folded, the shirt holder permitting such a garment to be stored in a stacked state, hung on a rack for display in a shop, or compactly packed in a suitcase or a trunk for carriage with the shape of the garment kept intact.

2. Related Art

In the laundry industry, it is a conventional practice to fold a laundered shirt and put it in a transparent soft plastic bag or wind a paper strap around it. This is disadvantageous in that the shirt is liable to lose its shape when it is packed in a suitcase or a trunk for carriage. When a plurality of shirts are stacked up for storage, underlaid shirts are liable to lose their shapes and, therefore, it is necessary to store the respective shirts on different shelves of a multi-shelf container. Further, shirts newly fabricated and to be delivered by a manufacture are each put in a paper box, and the stacking of the boxes results in bulkiness and hinders consumers from viewing the shirts for easy selection of a favorite one.

DISCLOSURE OF THE INVENTION

In accordance with the present invention, there is provided a shirt holder which comprises: a back pressing planar portion having a rectangular configuration for supporting a back face of a folded shirt; a front pressing planar portion facing opposite to the back pressing planar portion; a shirt collar protection portion; a connector portion bendably connecting an edge of the back pressing planar portion with an edge of the front pressing planar portion; and linear projections projecting inwardly of the front pressing planar portion and/or the back pressing planar portion; the back pressing planar portion, the front pressing planar portion, the shirt collar protection portion, the connector portion and the linear projections being integrally formed.

To pack a folded shirt in the shirt holder of the present invention, the front pressing planar portion is first opened, and the folded shirt is placed on the back pressing planar portion. Then, the front pressing planar portion is closed with the shirt held between the front and back pressing planar portions. Thus, the shirt packed in the shirt holder can be protected. The shirt holder of the present invention has a very simple construction and ensures ready packing and unpacking of a shirt. In addition, such shirt holders each containing a shirt can compactly be packed in a stacked state in a suitcase or a trunk with the shape of the shirt kept intact. The shirt holder prevents positional offset of a shirt held therein during storage or use. Further, the shirt holder can be fabricated at very low production costs.

In accordance with another aspect of the present invention, there is provided a shirt holder comprising: a back pressing planar portion having a rectangular configuration for supporting a back face of a folded shirt; a front pressing planar portion facing opposite to the back pressing planar portion; a shirt collar protection portion projecting from the front pressing planar portion; a connector portion bendably connecting a lower edge of the back pressing planar portion with a lower edge of the front pressing planar portion; and engagement portions formed on peripheral portions of the back pressing planar portion and the front pressing planar portion where the connector portion is not present, and adapted to engage the back pressing planar portion with the front pressing planar portion; the back pressing planar portion, the front pressing planar portion, the shirt collar protection portion, the connector portion and the engagement portions being integrally formed.

This shirt holder also has a very simple construction and ensures ready packing and unpacking of a shirt. In addition, such shirt holders each containing a shirt can compactly be packed in a stacked state in a suitcase or a trunk with the shape of the shirt kept intact. The shirt holder can more effectively prevent the positional offset of a shirt held therein during storage or use. Particularly where the shirt holder is hung on a rack for display of a shirt in a shop, the shirt holder prevents the shirt from sliding down within the shirt holder. Further, the shirt holder can be fabricated at very low production costs.

In accordance with a preferred embodiment of the present invention, the shirt holder has linear engagement projections formed on opposite edge portions of the back pressing planar portion and the front pressing planar portion for engaging the back pressing planar portion with the front pressing planar portion, the linear engagement projections vertically extending and projecting inwardly of the back pressing planar portion and the front pressing planer portion. The shirt holder may further include a linear projection projecting inwardly of at least either one of opposing surface portions of the back pressing planar portion and the front pressing planer portion and formed integrally therewith. With this construction, the shirt holder can more effectively prevent the positional offset of a shirt held therein. Further, the linear projection serves as a rib to reinforce the back pressing planar portion and/or the front pressing planar portion.

The shirt holder of the present invention may be constructed such that the connector portion is provided to connect an upper edge of the back pressing planar portion with an upper edge of the front pressing planar portion. More specifically, the shirt holder having such a construction in accordance with another preferred embodiment of the present invention comprises: a back pressing planar portion having a rectangular configuration for supporting a back face of a folded shirt; a front pressing planar portion facing opposite to the back pressing planar portion; a shirt collar protection portion projecting from the front pressing planar portion; a connector portion bendably connecting an upper edge of the back pressing planar portion with an upper edge of the front pressing planar portion; and engagement portions formed on peripheral portions of the back pressing planar portion and the front pressing planar portion where the connector portion is not present, and adapted to engage the back pressing planar portion with the front pressing planar portion; the back pressing planar portion, the front pressing planar portion, the shirt collar protection portion, the connector portion and the engagement portions being integrally formed.

The shirt holder of the present invention may be constructed such that the connector portion is provided to connect a right or left edge of the back pressing planar portion with a right or left edge of the front pressing planar portion. More specifically, the shirt holder having such a construction in accordance with further another preferred embodiment of the present invention comprises: a back pressing planar portion having a rectangular configuration for supporting a back face of a folded shirt; a front pressing planar portion facing opposite to the back pressing planar portion; a shirt collar protection portion projecting from the front pressing planar portion; a connector portion bendably connecting a right or left edge of the back pressing planar portion with a right or left edge of the front pressing planar portion; and engagement portions formed on peripheral portions of the back pressing planar portion and the front pressing planar portion where the connector portion is not present, and adapted to engage the back pressing planar portion with the front pressing planar portion; the back pressing planar portion, the front pressing planar portion, the shirt collar protection portion, the connector portion and the engagement portions being integrally formed.

The shirt holder of the present invention may be constructed such that the engagement portions for engaging the back pressing planar portion with the front pressing planar portion are not provided. More specifically, the shirt holder having such a construction in accordance with still another preferred embodiment of the present invention comprises: a back pressing planar portion having a rectangular configuration for supporting a back face of a folded shirt; a front pressing planar portion facing opposite to the back pressing planar portion; a shirt collar protection portion projecting from the front pressing planar portion; a connector portion bendably connecting an edge of the back pressing planar portion with an edge of the front pressing planar portion and an edge of the collar protection portion; and a linear projection projecting inwardly of at least either one of opposing surface portions of the back pressing planar portion and the front pressing planar portion; the back pressing planar portion, the front pressing planar portion, the shirt collar protection portion, the connector portion and the linear projection being integrally formed. Where the shirt holder further includes a connector member for fastening an edge portion of the back pressing planar portion to an edge portion of the front pressing planar portion, a garment with a collar such as a shirt can be assuredly be packed in the shirt holder.

In accordance with further another preferred embodiment, the shirt holder includes a plurality of linear projections formed alternately on the back pressing planar portion and on the front pressing planar portion in a transversely slightly offset relation. The arrangement of these linear projections prevents the positional offset of a shirt held in the shirt holder. When the shirt holder is hung on a rack for display of a shirt in a shop, the shirt is prevented from sliding down within the shirt holder.

The configuration of the collar protection portion is not particularly limited, but the collar protection portion may have any of various shapes such as a hexagonal shape (tortoise-shell shape), a trapezoidal shape and a generally circular shape. Although the collar protection portion preferably projects outwardly, a collar protection frame having any of various shapes such as a hexagonal shape (tortoise-shell shape), a trapezoidal shape and a generally circular shape may be formed as the collar protection portion inside the shirt holder.

The configuration of the linear projections is not particularly limited, but edges of the linear projections are preferably rounded. Particularly, where the linear engagement projections of the shirt holder each have a rounded edge on a side thereof closer to a central portion of the shirt holder, the linear engagement projections softly abut against a shirt, preventing the wrinkling of the shirt. Alternatively, the linear engagement projections of the shirt holder may each be tapered in section on an inward side thereof, i.e., on a side thereof closer to a central portion of the shirt holder. Such an arrangement is preferred because the inside volume of the shirt holder for holding a garment with a collar such as a shirt is increased.

The shirt holder of the present invention is preferably molded from a transparent plastic material in an integral manner. Thus, a garment with a collar held in the shirt holder can be viewed through the shirt holder, so that the kind and conditions of the garment can be checked. Alternatively, the shirt holder may be molded from an opaque plastic material in an integral manner. A material colored blue, red, yellow, brown or the like may be used. Further, the shirt holder may be molded in an integral manner from a plastic material containing an additive such as a UV absorbing agent. The material for the shirt holder is not limited to these plastic materials, but a botanical material such as obtained from wood or leaves may be used. The shirt holder of the present invention may be formed with a venthole, but the formation of the venthole is not critical. Further, the shirt holder of the present invention is preferably imparted with an anti-bacterial property, but may be imparted with any other properties.

When two shirt holders of the present invention are combined with each other in an inverted relation with the projected collar protection portions thereof facing inward, the two shirt holders form a rectangular parallelepiped so that the combined shirt holders can be efficiently packed in a suitcase, a trunk or a like carrier bag. The collar protection portion may be formed with a linear projection adapted to be fitted in a trench formed on the outer face of the front pressing planar portion of another shirt holder of the same construction, the trench resulting from the formation of the linear projection on the inner face of the front pressing planar portion. In such a case, the linear projection formed on the collar protection portion of one shirt holder is brought in engagement with the trench on the outer face of the front pressing planar portion of the other shirt holder. Therefore, the two shirt holders can readily be combined with the collar protection portions thereof facing inward so that the packing efficiency can be improved.

The shirt holder may be provided with a hanger hook. Such shirt holders can be hung on a horizontally projecting bar in a laterally overlapping relation for display of shirts. In this case, the linear projections projecting inwardly of the front pressing planar portion and/or the back pressing planar portion firmly hold the shirt between the front and back pressing planar portions thereby to prevent the shirt from slipping down within the shirt holder. Particularly, where the spacing between the back pressing planar portion and the front pressing planar portion is progressively reduced from the top to the bottom of the shirt holder, the shirt can more firmly be held between the front and back pressing planar portions so that the shirt is more efficiently prevented from slipping down within the shirt holder.

Although the shirt holder of the present invention having the engagement portions as described above is a closed box type shirt holder, the shirt holder may be constructed as an open non-box type shirt holder such that no side wall but the connector portion is provided on the periphery of the shirt holder.

It is an object of the present invention to provide a shirt holder of a very simple construction for holding a shirt, which ensures ready packing and unpacking of a shirt and can be packed in a suitcase or a trunk at a higher volumetric packing efficiency with the shape of the shirt kept intact. It is another object of the present invention to provide a shirt holder which prevents the positional offset of a shirt during storage or use. It is further another object of the present invention to provide a shirt holder which can be hung on a rack for display of a shirt in a shop while preventing the shirt from sliding down within the shirt holder, and can be fabricated at very low production costs.

DESCRIPTION OF THE PREFERRED EMBODIMENTS

The present invention will hereinafter be described in further detail with reference to the attached drawings.

Figure 1:
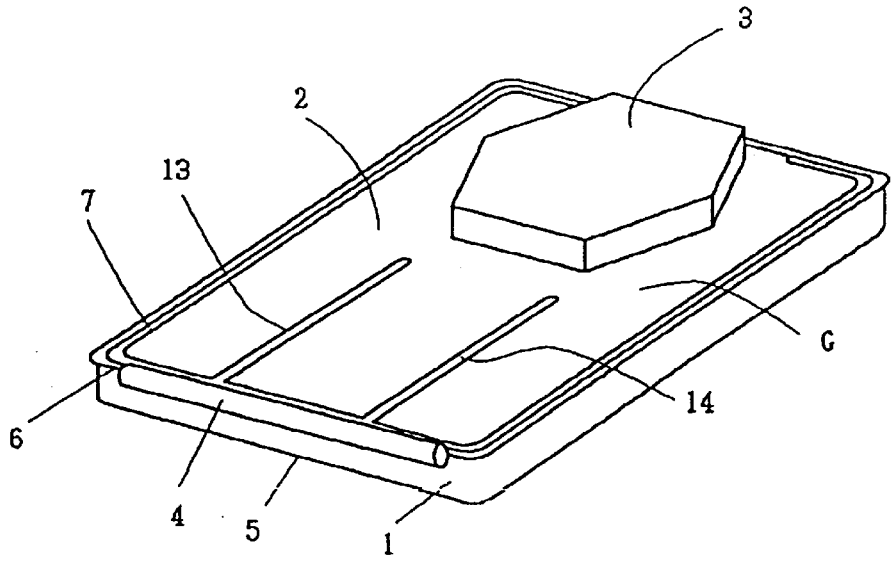
FIG. 1 is a perspective view illustrating a shirt holder in a closed state in accordance with one embodiment of the present invention.
Figure 2:
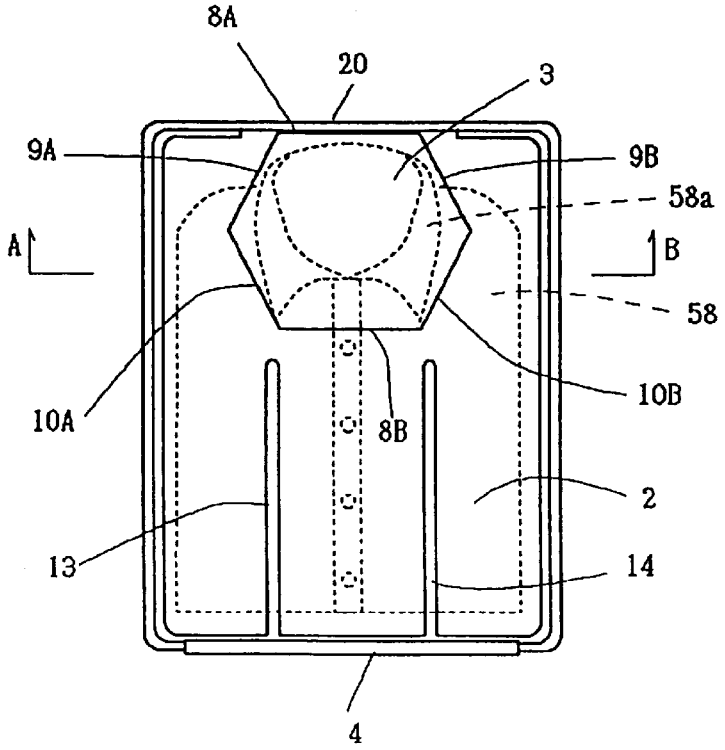
FIG. 2 is a front view of the shirt holder of FIG. 1.
Figure 3:
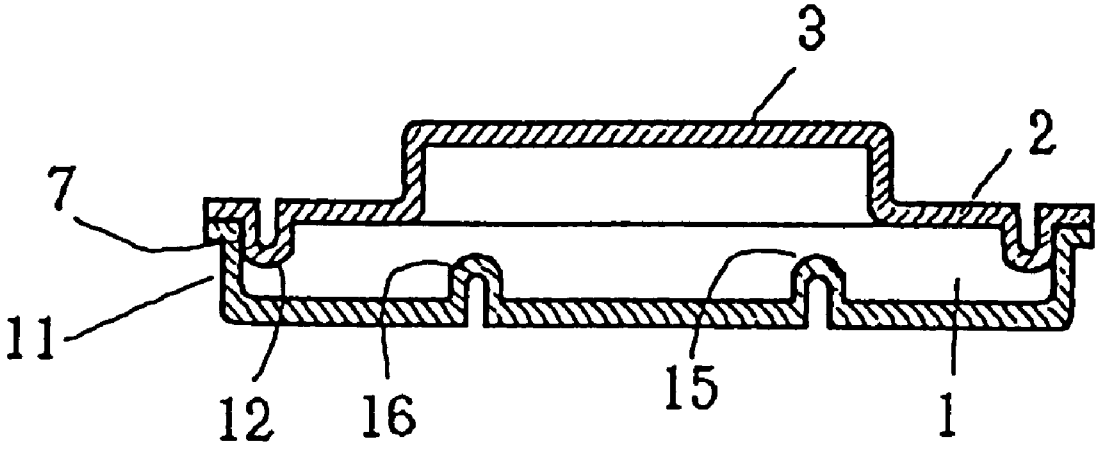
FIG. 3 is a sectional view of the shirt holder taken along a line A-B in FIG. 2.
Figure 4:
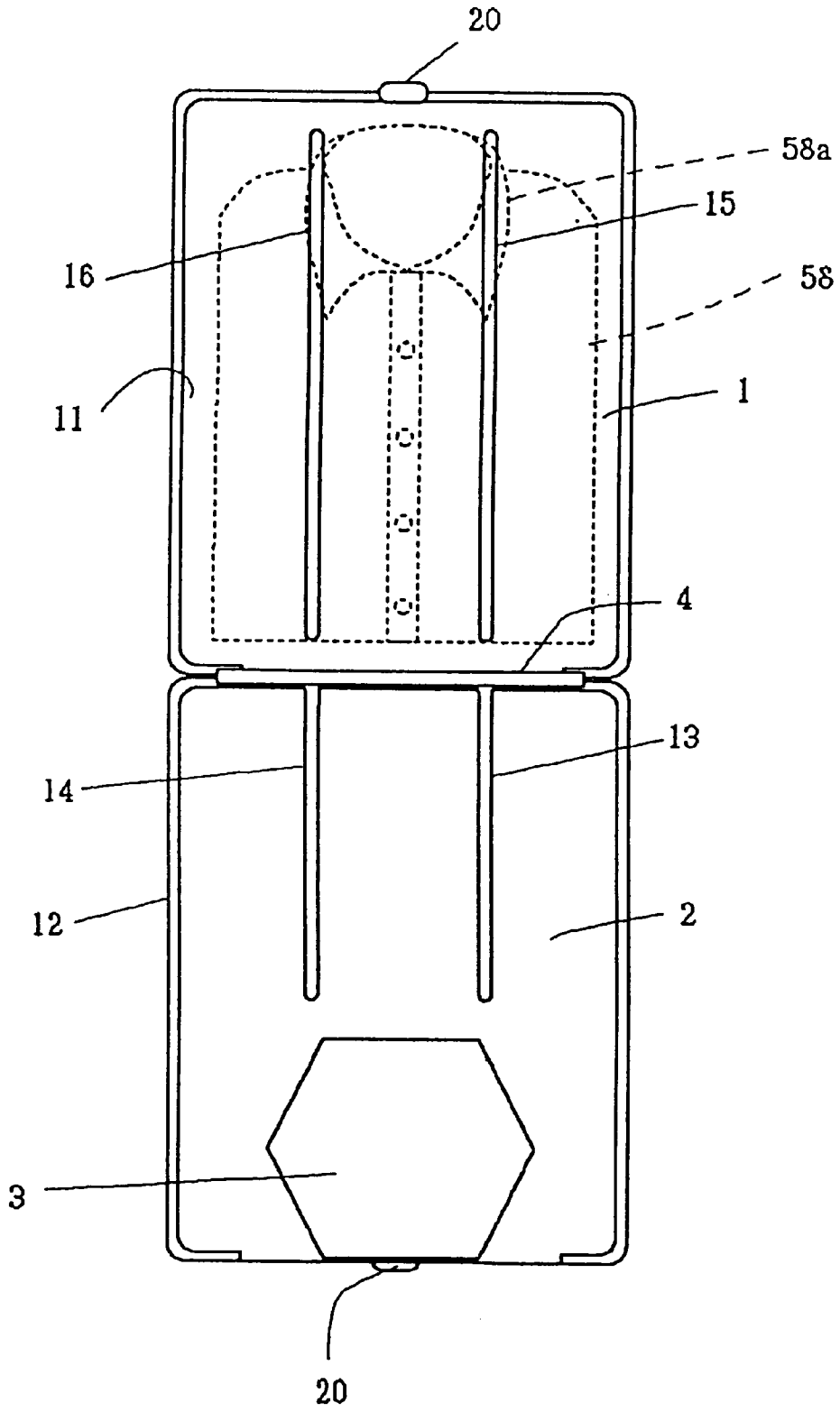
FIG. 4 is a perspective view illustrating the shirt holder of FIG. 1 in an open state.

FIG. 1 is a perspective view illustrating a shirt holder in a closed state in accordance with one embodiment of the present invention. FIG. 2 is a front view of the shirt holder of FIG. 1. FIG. 3 is a sectional view of the shirt holder taken along a line A-B in FIG. 2. FIG. 4 is a perspective view illustrating the shirt holder of FIG. 1 in an open state. The shirt holder according to the embodiment of the present invention is a box-type shirt holder entirely molded from a transparent plastic.

A back pressing planar portion 1 is configured like a rectangular container having substantially the same dimensions as a folded shirt G. A front pressing planar portion 2 has substantially the same width and length as the back pressing planar portion 1. A collar protection portion 3 is of a tortoise-shell shape, as viewed from the front, having an upper edge 8A, a lower edge 8B extending parallel to the upper edge 8A, and chevron-shaped edges 9A, 10A and 9B, 10B disposed in a symmetrical relation, and projects from the front pressing planar portion 2 in a parallel relation.

A connector portion 4 is formed integrally with the back pressing planar portion 1 and the front pressing planar portion 2 to resiliently connect a lower edge 5 of the back pressing planar portion 1 with a lower edge 6 of the front pressing planar portion 2 for opening and closing of the front pressing planar portion 2. The shirt holder is divided into a lower portion and an upper portion by the connector portion 4. The lower portion is shaped like a flat tray with a peripheral portion thereof standing upright to form a peripheral wall 11, while the upper portion has linear projections 12 (or trenches as viewed from the front in a closed state) formed as engagement portions 7 on a peripheral portion thereof for engagement with the peripheral wall 11 of the lower portion. Inward edges of the linear projections 12 are connected to the front pressing planar portion 2. A fastener 20 is provided which includes fastening members respectively formed integrally on upper edges of the back and front pressing planar portions 1 and 2 and serve to keep the back and front pressing planar portions 1 and 2 in a closed state. It is noted that the engagement portions of the shirt holder of the present invention does not necessarily comprise the linear projections 12.

As shown in FIG. 4, a shirt 58 is put in the container-like back pressing planar portion 1, and the front pressing planar portion 2 is folded along the connector portion 4. A collar 58*a* of the shirt 58 is fitted in the collar protection portion 3 having a cavity therein and, at the same time, the linear engagement projections 7 formed on the peripheral portion of the front pressing planar portion 2 are fitted along the peripheral wall 11 of the back pressing planar portion 1. Then, the upper edges of the front and back pressing planar portions 2 and 1 are fastened with the fastener 20. Thus, the entire shirt 58 is compactly packed in the shirt holder with its collar 58*a* protected by the collar protection portion 3. As shown in FIGS. 2, 3 and 4, the shirt 58 is supported between linear projections 13 and 14 projecting inwardly of the front pressing planar portion 2 and linear projections 15 and 16 projecting inwardly of the back pressing planar portion 1 and, hence, stably held in the shirt holder.

As described above, the back pressing planar portion 1 and the front pressing planar portion 2 each have linear projections for prevention of positional offset of a shirt. In FIGS. 1 and 4, the linear projections 13, 14 and the linear projections 15 and 16 are formed on the front pressing planar portion 2 and the back pressing planar portion 1, respectively, and extend longitudinally thereof. The linear projections on the back pressing planar portion 1 and the linear projections on the front pressing planar portion 2 may be arranged either in an overlapping relation or in a slightly offset relation when the shirt holder is closed. Since the linear projections 13 and 14 on the planar portion 2 and the linear projection 15 and 16 on the planar portion 1 are arranged in a slightly offset relation in this embodiment, the positional offset of the shirt within the shirt holder can be prevented more effectively, thereby ensuring stable packing of the shirt.

Figure 5:
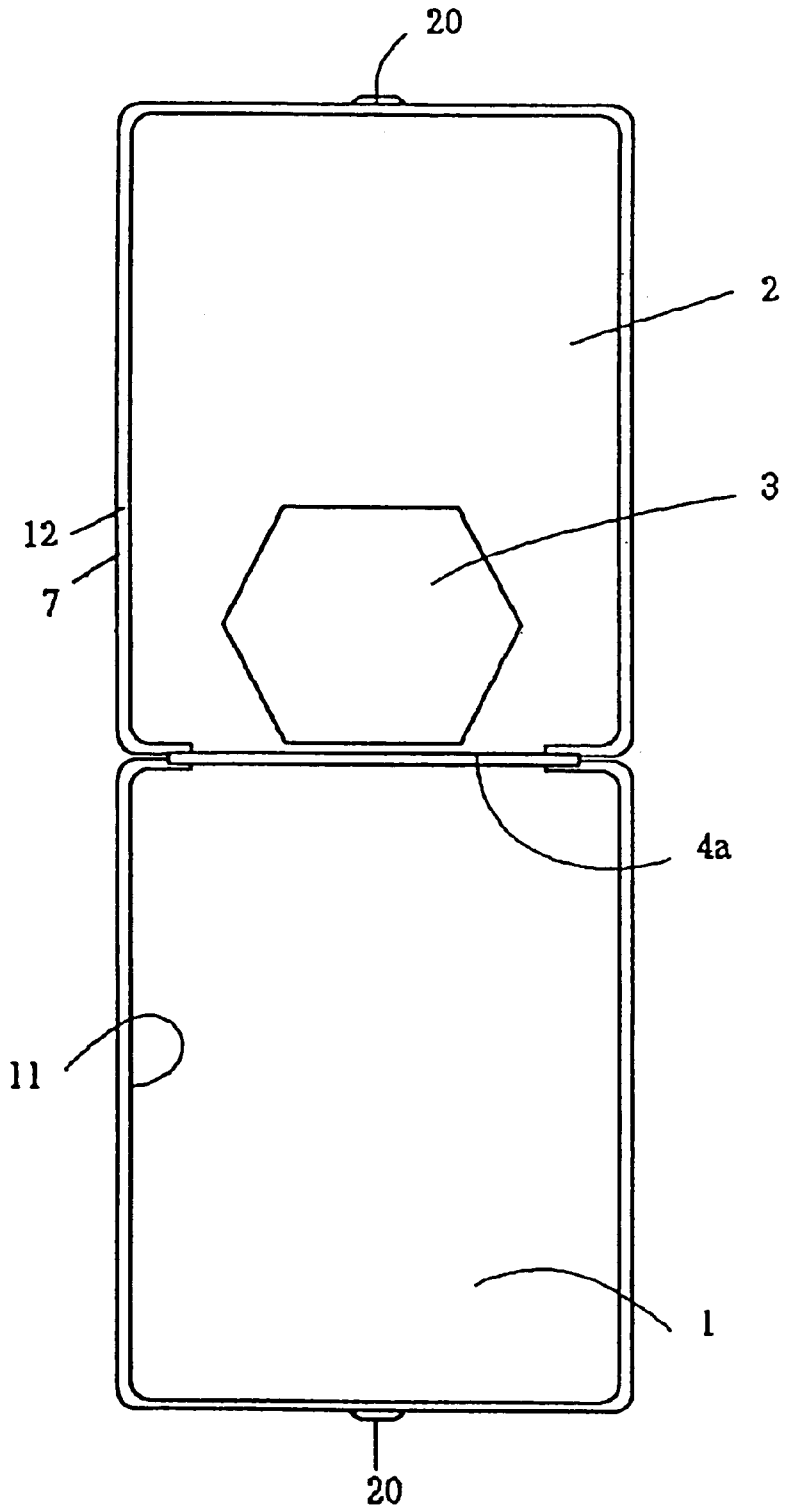
FIG. 5 is a perspective view illustrating a shirt holder in an open state in accordance with another embodiment of the present invention.

The shirt holder of the present invention may be constructed such that a connector portion 4*a* is provided on upper edges of the back and front pressing planar portions 1 and 2 as shown in FIG. 5. FIG. 5 is a front view illustrating the shirt holder in an open state in accordance with such an embodiment. The shirt holder includes the linear projections 12 as the engagement portions 7, but is not formed with the aforesaid linear projections 13, 14, 15 and 16. In this case, a shirt is put in the container-like back pressing planar portion 1, and the front pressing planar portion 2 is folded along the connector portion 4*a*. The collar of the shirt is fitted in the collar protection portion 3 having a cavity therein and, at the same time, the linear projections 12 formed as the engagement portions 7 on the peripheral portion of the front pressing planar portion 2 are fitted along the peripheral wall 11 of the back pressing planar portion 1. Then, the lower edges of the front and back pressing planar portions 2 and 1 are fastened with the fastener 20. Thus, the entire shirt is compactly packed in the shirt holder with its collar protected by the collar protection portion 3.

Figure 6:
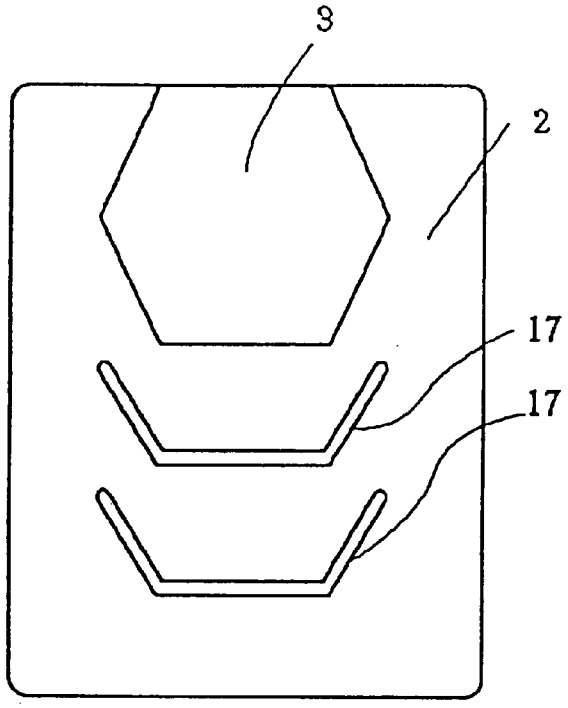
FIG. 6 is a front view illustrating one exemplary configuration of linear projections of a shirt holder according to the present invention.
Figure 7:
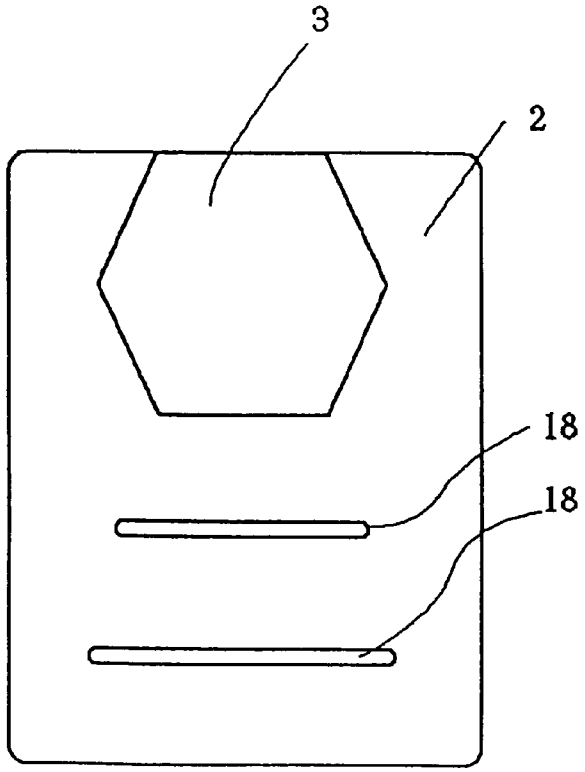
FIG. 7 is a front view illustrating another exemplary configuration of linear projections of a shirt holder according to the present invention.
Figure 8:
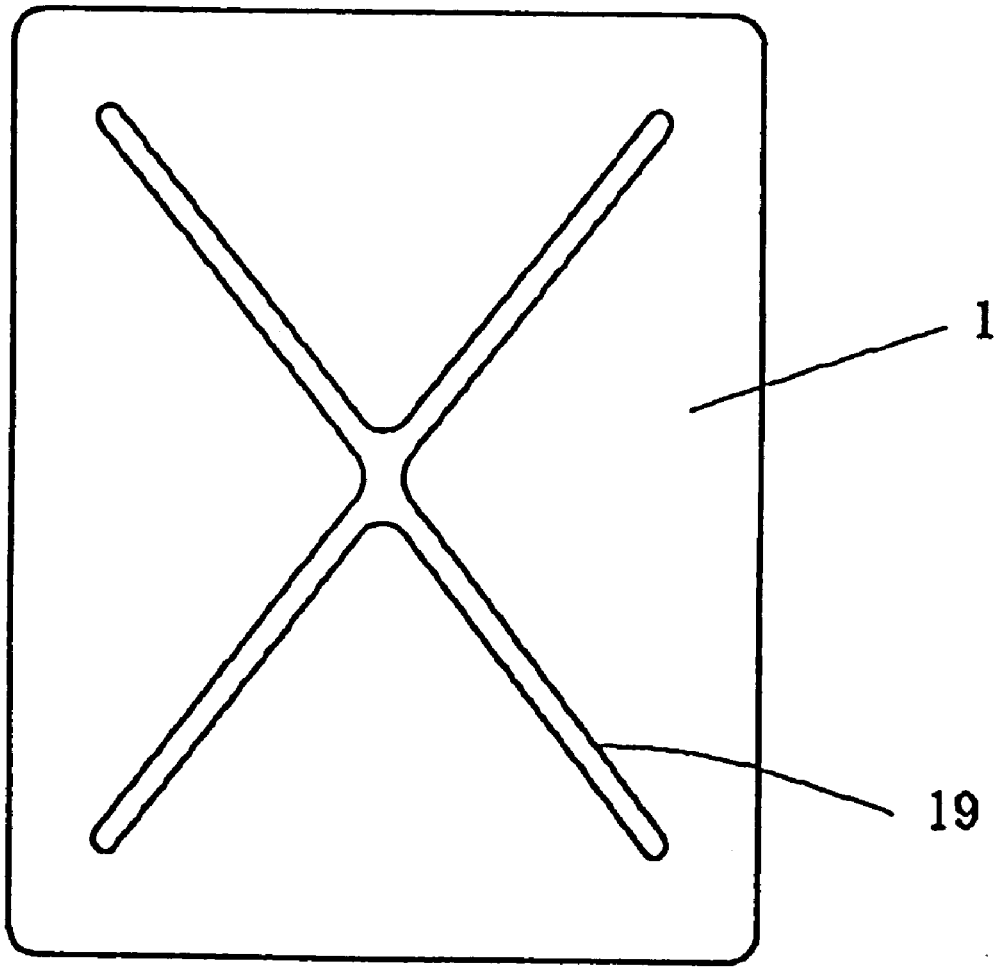
FIG. 8 is a front view illustrating further another exemplary configuration of linear projections of a shirt holder according to the present invention.

The linear projections may be configured in various ways. As shown in FIG. 6, linear projections 17, 17 may each be configured into a bent pattern extending parallel to edges of a lower half portion of the tortoise-shell-shaped collar protection portion 3. As shown in FIG. 7, linear projections 18, 18 may extend transversely in a parallel relation. As shown in FIG. 8, linear projections 19 may be formed in an X shape on the back pressing planar portion 1.

Figure 9:
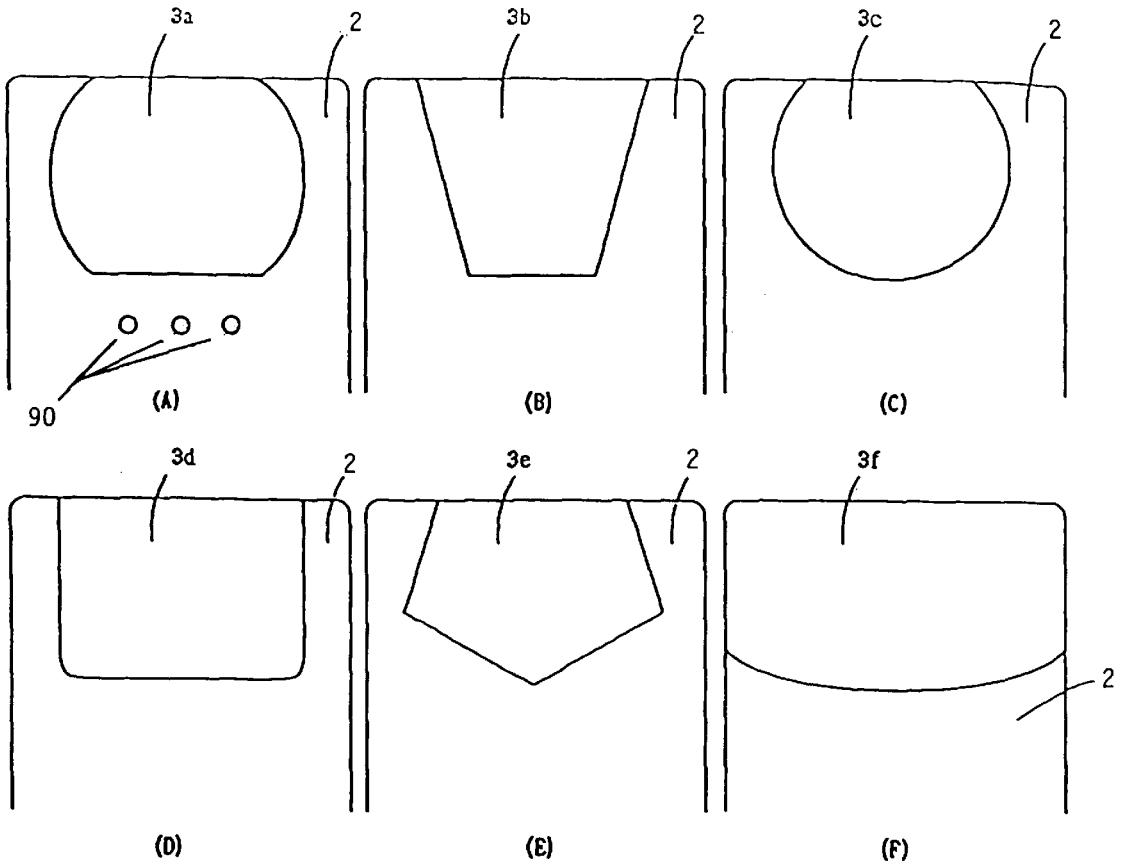
FIGS. 9(A) to 9(F) are front views illustrating various exemplary configurations of collar protection portions according to the present invention.
Figure 10:
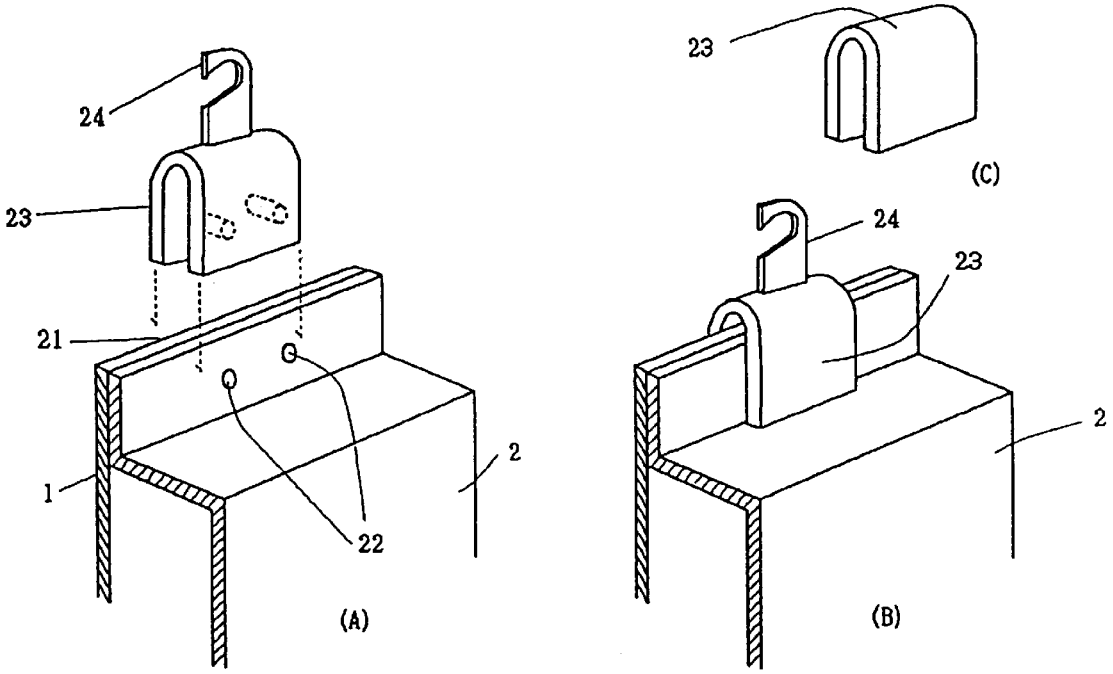
FIGS. 10(A) to 10(C) are perspective views illustrating exemplary hanger hooks according to the present invention.

The collar protection portion according to the present invention may be configured in any of various ways besides the tortoise-shell shape shown in FIG. 2. For example, the collar protection portion may be of a disk shape 3*a* as shown in FIG. 9(A), or may be of a trapezoidal shape 3*b* as shown in FIG. 9(B), of a circular or generally circular shape 3*c* as shown in FIG. 9(C), of a generally rectangular shape 3*d* as shown in FIG. 9(D), or of a pentahedral shape 3*e* as shown in FIG. 9(E), or may have an arcuate portion 3*f* extending from the right edge to the left edge of the planar portion 2 as shown in FIG. 9(F). In any of the aforesaid cases, the collar protection portion 3 preferably has a length M which is not greater than L/2 (L is the length of the front pressing planar portion 2).

Where the shirt holder of the present invention is to be hung on a rack with a shirt held therein for display, a hanger hook is provided on an intermediate portion of an upper side of the shirt holder. As shown in FIG. 10(A), flanges 21 are provided on the upper edges of the back pressing planar portion 1 and the front pressing planar portion 2, and a pair of small through-holes 22 are formed at a predetermined interval in intermediate portions of the flanges 21. A fastener for clamping the flanges 21 includes a fastening portion 23 of an inverted U cross section which is formed with a pair of projection pins projecting from an inner face thereof and adapted to be fitted through the pair of small through-holes 22. The inverted-U-shaped fastening portion 23 is resiliently opened to fit the projection pins through the small through-holes to clamp the flanges 21 as shown in FIG. 10(B). A hanger hook 24 is formed integrally on the top of the fastening portion 23. A fastener having only the fastening portion 23 may be used to keep the planar portions 1 and 2 closed as shown in FIG. 10(C).

To prevent the positional offset of a shirt or the like within the shirt holder in a hung state, the spacing between the back pressing planar portion 1 and the front pressing planar portion 2 may progressively be increased from the bottom to the top with the planar portions 1 and 2 inclined at an angle with respect to each other. Alternatively, the heights of the linear projections may progressively be increased from the top to the bottom, while the planar portions 1 and 2 are kept parallel to each other.

Figure 11:
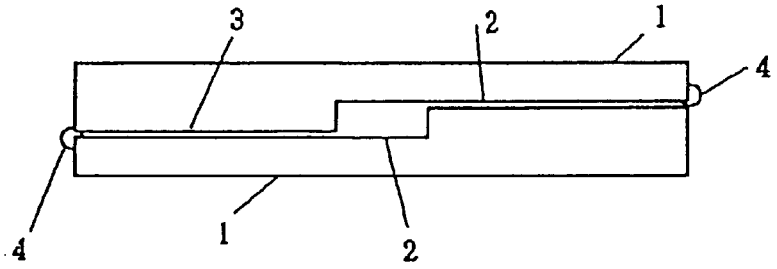
FIG. 11 is an explanatory diagram illustrating one exemplary use state of shirt holders of the present invention.
Figure 12:
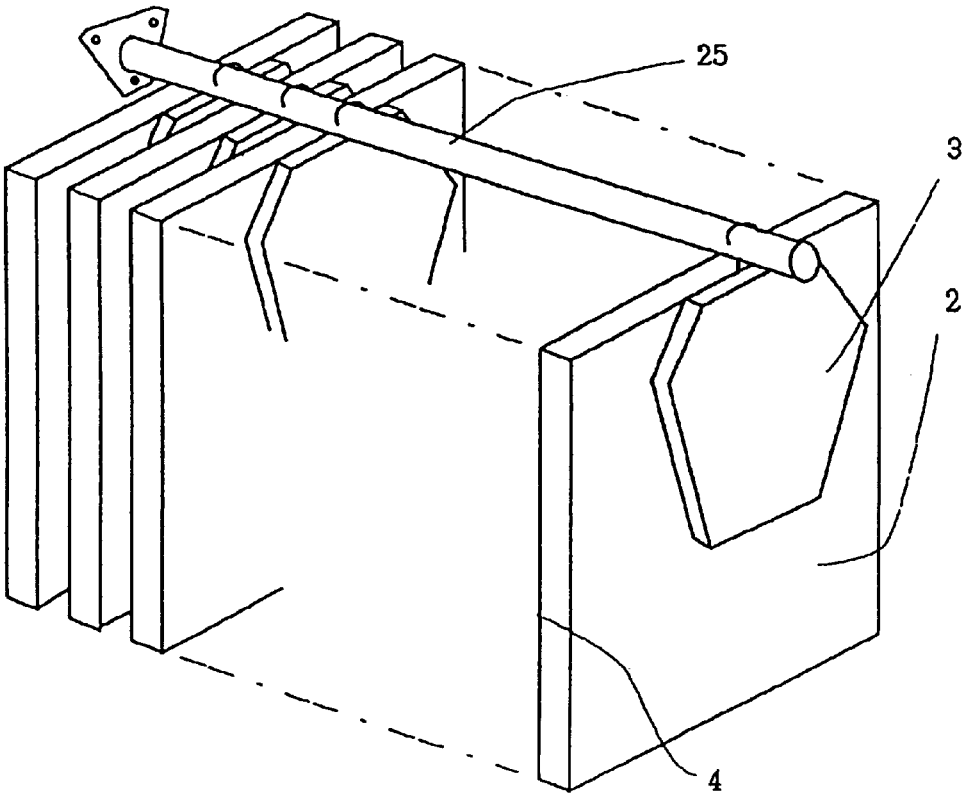
FIG. 12 is an explanatory diagram illustrating another exemplary use state of shirt holders of the present invention.

When a plurality of shirt holders of the present invention each containing a shirt are bundled, each two shirt holders are combined with each other in an inverted relation as shown in FIG. 11. Further, a plurality of transparent shirt holders of the present invention each holding a shirt can be hung on a bar 25 horizontally projecting from a wall, as shown in FIG. 12, for display of the shirts, permitting a consumer to readily see the shirts therethrough to select a shirt of his favorite color and design without dirtying the shirts.

Figure 13:
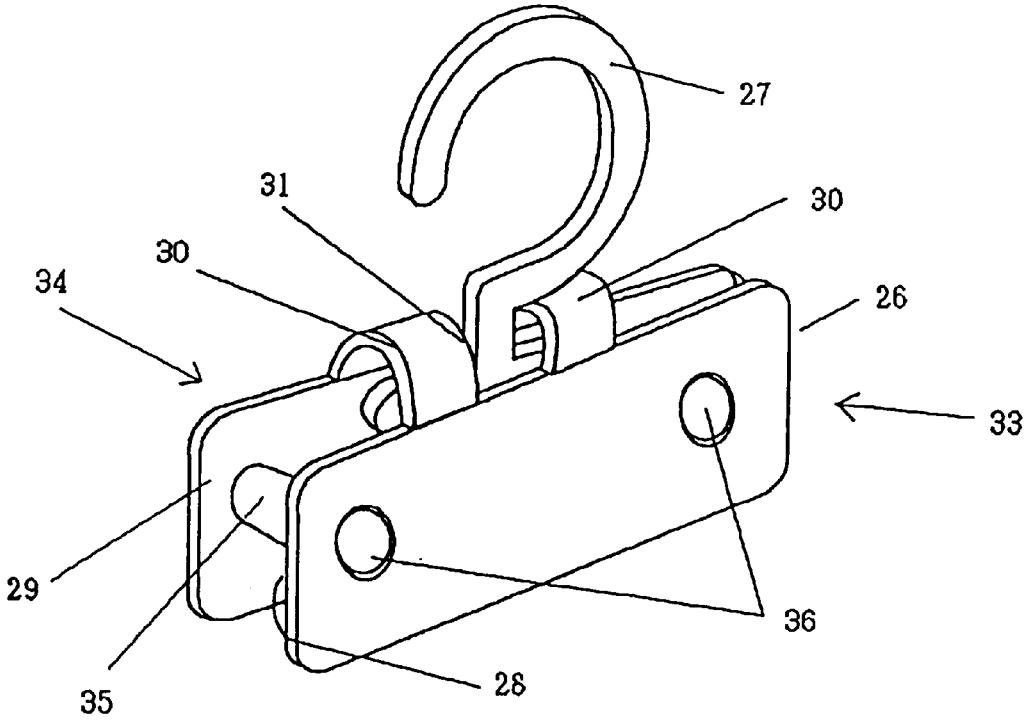
FIG. 13 is a perspective view illustrating one exemplary fastener according to the present invention.
Figure 14:
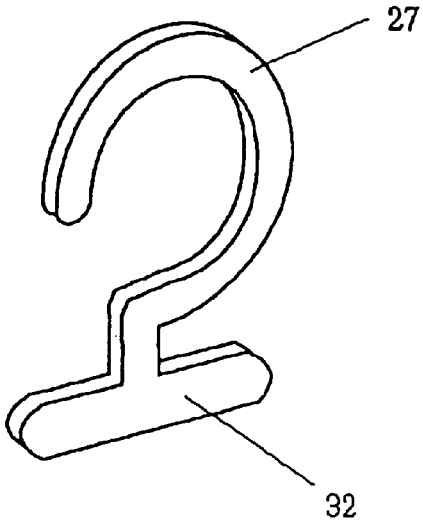
FIG. 14 is a perspective view illustrating one exemplary hanger hook of the fastener.

The fastener according to the present invention is not limited to that described above, but preferably includes a fastening portion having inner faces adapted to oppose to each other with the flanges interposed therebetween and resiliently openable, projection pins projecting from one of the inner faces of the fastening portion and adapted to be fitted through the small through-holes of the flanges, and engagement holes formed in the other inner face of the fastening portion and adapted to receive the projection pins. In FIGS. 13 and 14, there is shown an exemplary fastener 33 which includes a fastening portion 26 and a hanger hook 27 engaged with the fastening portion 26 and extending upright therefrom, the fastening portion 26 having bridges 30, 30 bridging a gap 31 between the inner faces 28 and 29 thereof, the hanger hook 27 having a fastener piece 32 to be inserted into the gap 31 of the fastening portion 26 for engagement with the bridges 30 of the fastening portion 26. In FIGS. 13 and 14, a reference numeral 35 denotes projection pins formed on the inner face 29 of the fastening portion 26, and a reference numeral 36 denotes engagement holes formed in the inner face 28 of the fastening portion 26. The projection pins 35 are fitted through the small through-holes of the flanges of the shirt holder and brought into engagement with the engagement holes 36 of the fastening portion 26. Thus, the shirt holder is fastened by the fastener 33.

Figure 15:
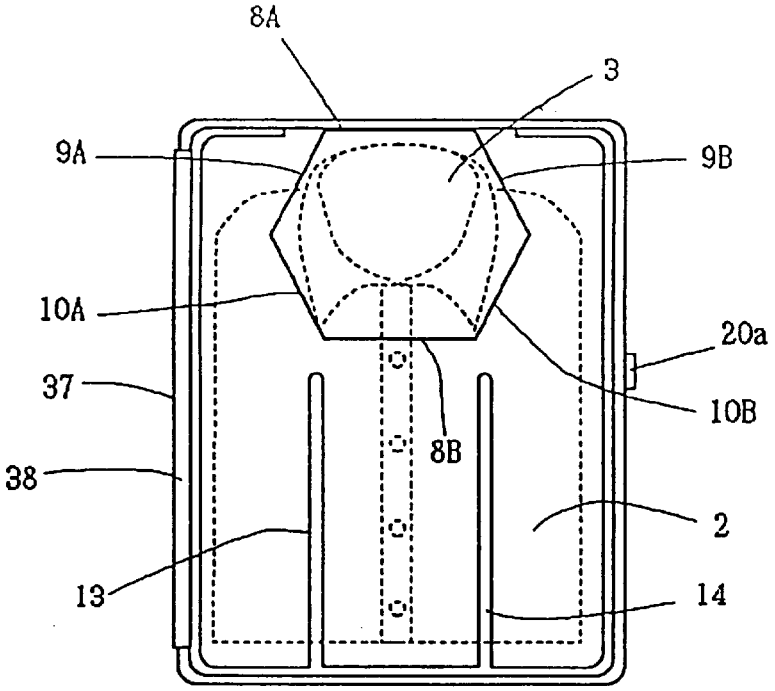
FIG. 15 is a front view illustrating a shirt holder according to further another embodiment of the present invention.

The present invention may otherwise be embodied such that the shirt holder includes a connector portion 38 bendably connecting a left edge of the back pressing planar portion 1 with a left edge 37 of the front pressing planar portion 2 and formed integrally therewith as shown in FIG. 15. In FIG. 15, a reference character 20*a* denotes a fastener.

Figure 16:
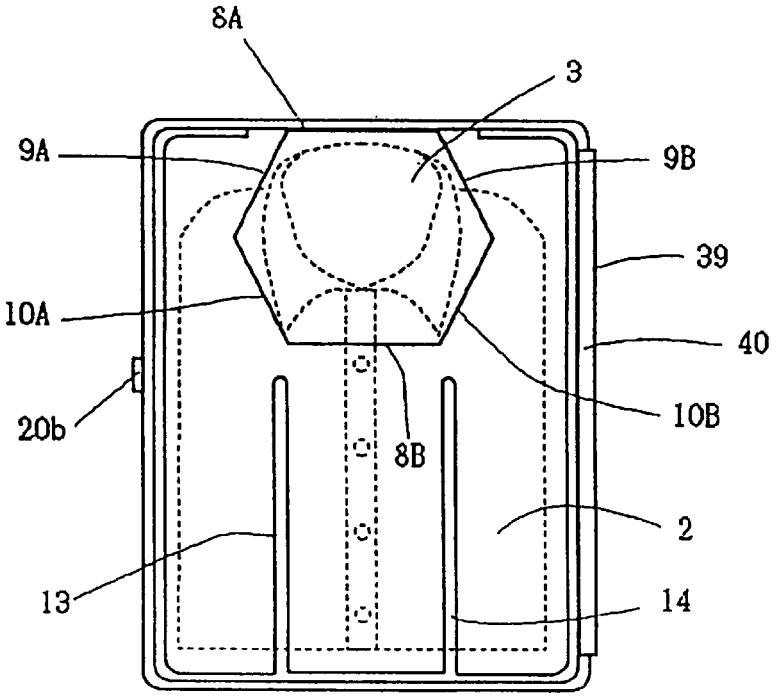
FIG. 16 is a front view illustrating a shirt holder according to still another embodiment of the present invention.

Alternatively, the present invention may be embodied such that the shirt holder includes a connector portion 40 bendably connecting a right edge of the back pressing planar portion 1 with a right edge 39 of the front pressing planar portion 2 and formed integrally therewith as shown in FIG. 16. In FIG. 16, a reference character 20*b* denotes a fastener.

Figure 17:
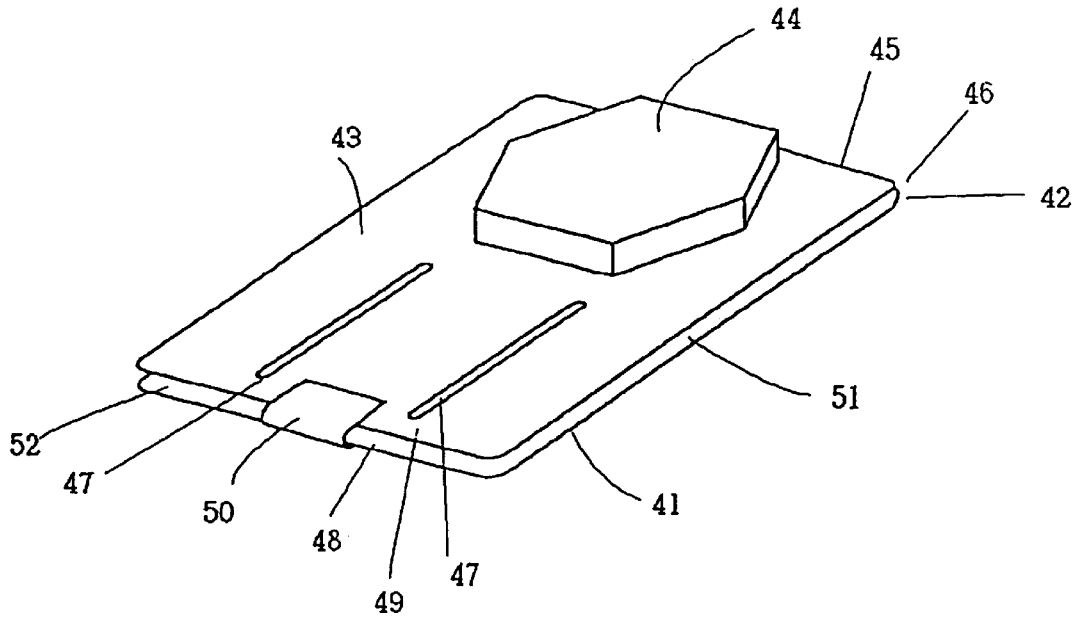
FIG. 17 is a front view illustrating a shirt holder according to further another embodiment of the present invention.

The present invention may otherwise be embodied such that the shirt holder is not formed with the engagement portions 7 for engaging the back pressing planar portion 1 and the front pressing planar portion 2. More specifically, the shirt holder has a connector portion 46 bendably connecting an upper edge 42 of a back pressing planar portion 41 with an upper edge 45 of a front pressing planar portion 43 and an upper edge of the collar protection portion 44 and formed integrally therewith, and linear projections 47 projecting inwardly of opposing surface portions of the back pressing planar portion 41 and the front pressing planar portion 43 and formed integrally therewith, as shown in FIG. 17. In this case, the shirt holder includes a connector member 50 for fastening a lower portion 48 of the back pressing planar portion 41 to a lower portion 49 of the front pressing planar portion 43 instead of the engagement portions. Thus, the shirt holder can assuredly hold therein a garment with a collar such as a shirt. In FIG. 17, reference numerals 51 and 52 denote an open space.

Figure 18:
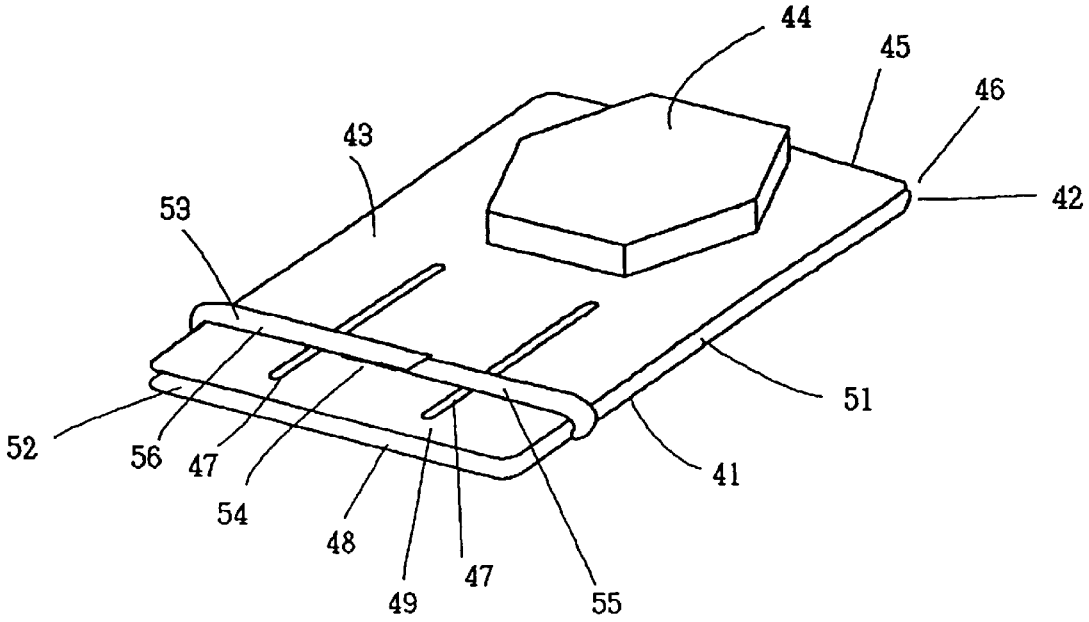
FIG. 18 is a sectional view illustrating a shirt holder according to still another embodiment of the present invention.

Alternatively, the present invention may be embodied such that the shirt holder includes a connector member 53 for fastening the lower portion 48 of the back pressing planar portion 41 to the lower portion 49 of the front pressing planar portion 43 as shown in FIG. 18. The connector member 53 has a detachable facial fastener 54 provided in a middle portion thereof and comprises a pair of belt members 55 and 56 which are respectively attached to opposite side edges of the back pressing planar portion 41. Thus, the front pressing planar portion 43 is fastened by the belt members 55 and 56.

Figure 19:
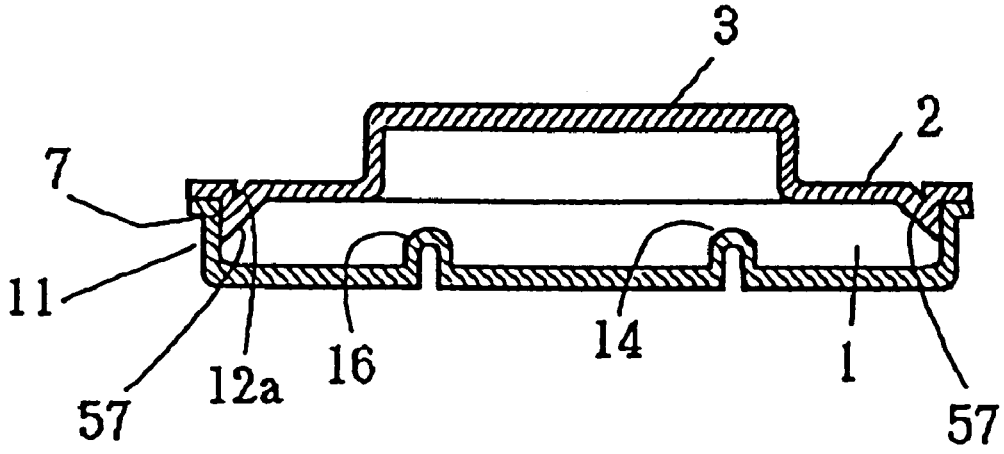
FIG. 19 is a sectional view illustrating exemplary engagement portions of a shirt holder according to the present invention.

Further, the linear projections 12*a* as the engagement portions 7 shown in FIG. 3 may each have a generally V-shaped or tapered cross section 57 on an inward side thereof, i.e., on a side thereof closer to the central portion of the shirt holder as shown in FIG. 19. Such an arrangement is preferred because the inside volume of the shirt holder for holding a garment with a collar such as a shirt is increased.

The shirt holder can be formed with a venthole (FIG. 9, element 90), but the formation of the venthole is not critical.

With the use of the shirt holder of the present invention, freshly laundered or newly fabricated shirts can be kept away from dirt with the shapes thereof kept intact when stacked up for storage or packed in a suitcase, a trunk or the like by a shirt maker, a shirt laundry, a laundry, a hotel laundry agent, a traveler or the like.

The shirt holder of the present invention, which has a very simple configuration and construction, can be fabricated at very low production costs. In addition, the shirt holder is reusable and, therefore, advantageous in terms of resource saving and economics. For example, a person who received a shirt holder of the present invention from a laundry during his stay at a hotel can reuse the shirt holder repeatedly.

Further, an illustration, a photograph, a corporate advertisement, a tourist map or the like can be printed on the inner or outer surface of the back pressing planar portion or the front pressing planar portion of the shirt holder. If all or part of the front portion of the shirt holder is made transparent, a consumer can see a shirt through the shirt holder to check the material, color and design of the shirt.

Where a synthetic resin material is used for production of the shirt holder of the present invention, for example, injection molding, vacuum forming or the like may be employed. For example, a thin-wall shirt holder can be produced at lower production costs by the vacuum forming of polyethylene, polyethylene terephthalate, polypropylene or the like. Such a shirt holder can be conveniently used and stored.

As described above, the shirt holder of the present invention for holding a man's shirt newly fabricated and to be delivered by a maker, or a man's shirt, a lady's blouse or a sports shirt such as a polo shirt freshly laundered and neatly folded permits the shirt or the like to be stored in a stacked state, hung on a rack for display in a shop, or compactly packed in a suitcase or a trunk for carriage with the shape of the shirt kept intact.

What is claimed is:

1. A shirt holder comprising:

a back pressing planar portion having a rectangular configuration for supporting a back face of a folded shirt;

a front pressing planar portion facing opposite to the back pressing planar portion;

a shirt collar protection portion;

a connector portion bendably connecting an edge of the back pressing planar portion with an edge of the front pressing planar portion; and a longitudinal linear projection projecting inwardly of at least either one of the front pressing planar portion and the back pressing planar portion and disposed to compress down a shirt packed in the shirt holder;

the back pressing planar portion, the front pressing planar portion, the shirt collar protection portion, the connector portion and the linear projection being integrally formed.

2. A shirt holder as set forth in claim 1, further comprising linear engagement projections formed on opposite edge portions of the back pressing planar portion and the front pressing planar portion for engaging the back pressing planar portion with the front pressing planar portion, the linear engagement projections projecting inwardly of the back pressing planar portion and the front pressing planer portion and extending longitudinally thereof.

3. A shirt holder as set forth in claim 2, wherein the linear engagement projections each have a rounded edge on an inward side thereof closer to a central portion of the shirt holder.

4. A shirt holder as set forth in claim 1, wherein the linear projection projects inwardly of at least either one of opposing surface portions of the back pressing planar portion and the front pressing planer portion.

5. A shirt holder as set forth in claim 4, wherein linear projections formed on both of the opposing surface portions of the back pressing planar portion and the front pressing planar portion extend longitudinally thereof.

6. A shirt holder as set forth in claim 5, wherein the linear projection includes a plurality of linear projections formed alternately on the opposing surface portions of the back pressing planar portion and the front pressing planar portion in a transversely slightly offset relation.

7. A shirt holder as set forth in claim 4, wherein the linear projection formed on at least either one of the opposing surface portions of the back pressing planar portion and the front pressing planar portion is configured into a bent pattern extending parallel to an edge of a lower half portion of the collar protection portion.

8. A shirt holder as set forth in claim 4, wherein the linear projection includes a plurality of linear projections formed on at least either one of the opposing surface portions of the back pressing planar portion and the front pressing planar portion and transversely arranged in a parallel relation.

9. A shirt holder as set forth in claim 1, wherein the collar protection portion is formed with a linear projection adapted to be fitted in a trench formed on an outer face of a front pressing planar portion of another shirt holder of the same construction, the trench resulting from the formation of the linear projection on an inner face of the front pressing planar portion.

10. A shirt holder as set forth in claim 1, wherein the linear projection has a rounded edge.

11. A shirt holder as set forth in claim 1, wherein a spacing between the back pressing planar portion and the front pressing planar portion progressively decreases from the top to the bottom of the shirt holder.

12. A shirt holder as set forth in claim 1, which is molded from a transparent plastic material.

13. A shirt holder as set forth in claim 1, further comprising a venthole.

14. A shirt holder as set forth in claim 1, which is imparted with an anti-bacterial property.

15. A shirt holder as set forth in claim 1, further comprising flanges respectively formed on upper edges of the back pressing planar portion and the front pressing planar portion and each having a small through-hole, and a fastener having a projection pin insertable into the small through-hole and attached to the flanges formed on the upper edges of the back pressing planar portion and the front pressing planar portion.

16. A shirt holder as set forth in claim 15, wherein the fastener includes a fastening portion having inner faces adapted to oppose to each other with the flanges interposed therebetween and resiliently openable, one of the inner faces of the fastening portion being formed with the projection pin insertable into the small through-holes of the flanges, the other inner face of the fastening portion being formed with an engagement hole for engagement with the projection pin.

17. A shirt holder as set forth in claim 16, wherein the fastener further includes a hanger hook extending upright from the fastening portion and engaged therewith, the fastening portion having a bridge bridging a gap between the pair of inner faces thereof, the hanger hook having a fastener piece to be inserted into the gap of the fastening portion for engagement with the bridge of the fastening portion.

18. A fastener according to claim 1, further comprising engagement portions formed on peripheral portions of the back pressing planar portion and the front pressing planar portion where the connector portion is not present, and disposed to engage the back pressing planar portion with the front pressing planar portion.

19. A shirt holder, comprising:

a back pressing planar portion having a rectangular configuration for supporting a back face of a folded shirt;

a front pressing planar portion facing opposite to the back pressure planar portion;

a shirt collar protection portion;

a connector portion bendably connecting an edge of the back pressing planar portion with an edge of the front pressing planar portion; and a linear projection projecting inwardly of at least either one of the front pressing planar portion and the back pressing planar portion; and linear engagement projections formed on opposite edge portions of the back pressing planar portion and the front pressing planar portion for engaging the back pressing planar portion with the front pressing planar portion, the linear engagement projections projecting inwardly of the back pressing planar portion and the front pressing planar portion and extending longitudinally thereof;

wherein the back pressing planar portion, the front pressing planar portion, the shirt collar protection portion, the connector portion and the linear projection being integrally formed; and wherein the linear engagement projections each have a tapered cross section on an inward side thereof.

20. A shirt holder comprising:

a back pressing planar portion having a rectangular configuration for supporting a back face of a folded shirt;

a front pressing planar portion facing opposite to the back pressing planar portion;

a shirt collar protection portion projecting from the front pressing planar portion;

a connector portion bendably connecting an edge of the back pressing planar portion with an edge of the front pressing planar portion; and a plurality of longitudinal linear projections projecting inwardly of both opposing surface portions of the front pressing planar portion and the back pressing planar portion and disposed to compress down a shirt packed in the holder;

the back pressing planar portion, the front pressing planar portion, the shirt collar protection portion, the connector portion and the linear projection being integrally formed.

21. A shirt holder as set forth in claim 20, further comprising a connector member for fastening an edge portion of the front pressing planar portion to an edge portion of the back pressing planar portion.

22. A shirt holder as set forth in claim 20, wherein the linear projection formed on at least either one of the opposing surface portions of the back pressing planar portion and the front pressing planar portion extends longitudinally thereof.

23. A shirt holder as set forth in claim 20, wherein the linear projection includes a plurality of linear projections formed alternately on the opposing surface portions of the back pressing planar portion and the front pressing planar portion in a transversely slightly offset relation.

24. A fastener for a shirt holder having back and front pressing planar portions, the planar portions having upper edges, flanges on the upper edges, and one or more through-holes formed in the flanges, the fastener comprising:

a fastening portion having opposing inner faces; and a hanger hook extending upright from the fastening portion and engaged therewith;

the fastening portion including one or more projection pins formed on one of the inner faces thereof and disposed to be inserted into the one or more through-holes, an engagement hole formed in the other inner face thereof for engagement with the one or more projection pins, and a resiliently deformable bridge bridging a gap between the pair of inner faces.

25. A fastener for a shirt holder according to claim 24, wherein the hanger hook has an engagement piece disposed to be inserted into the gap of the fastening portion for engagement with the bridge of the fastening portion.

26. A shirt holder comprising:

a back pressing planar portion having a rectangular configuration for supporting a back face of a folded shirt;

a front pressing planar portion facing opposite to the back pressing planar portion;

a shirt collar protection portion;

a connector portion bendably connecting an edge of the back pressing planar portion with an edge of the front pressing planar portion; and an X-shaped linear projection projecting inwardly of at least either one of the front pressing planar portion and the back pressing planar portion and disposed to compress down a shirt packed in the shirt holder;

the back pressing planar portion, the front pressing planar portion, the shirt collar protection portion, the connector portion and the linear projection being integrally formed.

27. A shirt holder according to claim 26, wherein the X-shaped linear projection is on the back pressing planar portion.

* * * * *